US006234607B1

(12) United States Patent
Sakai et al.

(10) Patent No.: US 6,234,607 B1
(45) **Date of Patent: *May 22, 2001**

(54) INK JET HEAD AND CONTROL METHOD FOR REDUCED RESIDUAL VIBRATION

(75) Inventors: Shinri Sakai; Masahiro Fujii, both of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 619 days.

(21) Appl. No.: 08/633,616

(22) Filed: Apr. 17, 1996

(30) Foreign Application Priority Data

| | | |
|---|---|---|
| Apr. 20, 1995 | (JP) | 7-095708 |
| Jul. 27, 1995 | (JP) | 7-192283 |
| Aug. 4, 1995 | (JP) | 7-199814 |

(51) Int. Cl.[7] ..... B41J 2/04
(52) U.S. Cl. ..... 347/54; 347/10
(58) Field of Search ..... 347/54, 11, 94, 347/20

(56) References Cited

U.S. PATENT DOCUMENTS

| | | | | |
|---|---|---|---|---|
| 4,284,996 | * | 8/1981 | Greve | 347/11 |
| 4,424,520 | | 1/1984 | Matsuda et al. | 346/140 R |
| 4,523,200 | | 6/1985 | Howkins | 346/140 R |
| 5,513,431 | | 5/1996 | Ohno et al. | 347/54 X |
| 5,534,900 | * | 7/1996 | Ohno et al. | 347/54 |
| 5,644,341 | * | 7/1997 | Fujii et al. | 345/11 |

FOREIGN PATENT DOCUMENTS

| | | |
|---|---|---|
| 0 375 147 | 6/1990 | (EP) . |
| 0 479 441 | 4/1992 | (EP) . |
| 0 573 055 | 12/1993 | (EP) . |
| 0 629 503 | 12/1994 | (EP) . |
| 55-079171 | 6/1980 | (JP) . |
| 56-161172 | 12/1981 | (JP) . |

* cited by examiner

*Primary Examiner*—Benjamin R. Fuller
*Assistant Examiner*—C. Dickens

(57) ABSTRACT

Techniques for improving stable ink droplet ejecting at high speeds and associated ink jet print heads for use in recording apparatuses. Particularly, residual vibration in the elastic, deformable diaphragms used to expel ink from an individual nozzle are dampened or eliminated by applying a secondary driving signal a preselected period of time after the primary ejection signal has been transmitted. Ideally, this secondary signal is applied just when the vibrating diaphragm most closely approaches a stationary wall normally separated therefrom by a predetermined gap distance, at least when electrostatic action is used to deform the diaphragm. Moreover, the secondary driving signal is smaller in magnitude yet longer in duration in the primary ejection signal to insure an orderly dissipation of diaphragm vibration without ejecting undesired satellite drops. Also disclosed are the use of diaphragms having portions of varying thickness and/or surface area in either a discrete or continuous fashion to tailor the diaphragm rigidity and deformation characteristics according to desired operating characteristics.

21 Claims, 13 Drawing Sheets

FIG. 7A charge signal (IN1)

FIG. 7B discharge signal for ink droplet ejecting (IN2)

FIG. 7C discharge signal for diaphragm returning (IN3)

FIG. 7D voltage between opposing electrodes

INK JET HEAD AND CONTROL METHOD FOR REDUCED RESIDUAL VIBRATION

BACKGROUND OF THE INVENTION

1. Field of the Invention

The present invention relates generally to ink jet printing technology, and is particularly concerned with techniques for suppressing residual ink vibration after ink droplet ejection from the ink jet head.

2. Description of the Related Art

In general, an ink jet head comprises a pressure generating ink ejection chamber for applying pressure to ink to selectively eject it therefrom. One end of the pressure generating chamber is typically connected to an ink tank through an ink supply path, and the other end connects to a nozzle opening from which the ink drops can be ejected. Part of the pressure generating chamber is made to be easily deformed and functions as a diaphragm. This diaphragm is elastically displaced or deformed by an electromechanical converter such as a piezoelectric or electrostatic driver to selectively generate the pressure that ejects ink drops from the nozzle opening.

Recording apparatuses using this type of ink jet head offer outstanding operating characteristics, including low operating noise and low power consumption, and are widely used as hard copy output devices for a variety of information processing devices. As the performance and functionality of information processing devices has improved, demand has also risen for even higher quality and speed printing both text and graphics. This has made urgent the development of technologies enabling even finer ink drops to be ejected consistently at even higher frequencies or print speed.

Because of the structure of the ink jet head as described above, vibration remains in the ink inside the pressure generating chamber (also called the ink chamber because it is filled with ink; hereafter "ink chamber") after ink ejection, and this residual vibration can easily result in the formation of undesirable ejected ink droplets (also called "satellites"). To avoid this, the conventional approach has been to increase the flow resistance of the ink supply path connecting the ink chamber and ink tank to alternate the residual ink vibration. However, if the flow resistance of the ink supply path is high, the ink refill supply rate of ink to the ink chamber after ink ejecting is reduced, thereby lowering the maximum ink eject frequency, and ultimately the printing speed of the printing device.

Alternatively, as described in JP-A-S56-161172 (1981-161172), residual vibration can be canceled, and satellite emissions thereby prevented, by applying at an appropriate timing after the diaphragm drive signal a complementary signal canceling the residual vibration of the diaphragm. This resolves the problem described above, at least for non-varying droplet applications, and achieves a recording apparatus with a high output speed.

However, with the technology described in JP-A-S56-161172 (1981-161172), the diaphragm must be driven at an appropriate timing determined by the specific vibration period of the ink vibration system in order to cancel the residual vibration of the diaphragm. This is because residual diaphragm vibration may actually be promoted if the cancel signal timing is inappropriate. The technology described in JP-A-S56-161172 (1981-161172) therefore provides a variable resistor for adjusting the signal timing according to the specific vibration period of the ink vibration system. The problem here is that a sufficient vibration damping effect may not be achieved when any of the parameters determining the specific vibration period of the ink vibration system, e.g., the ink viscosity, change as a result of environmental changes, typical of which are ambient temperature fluctuations.

Also, expressing various density gradations by changing the size of the ink droplets formed on the recording medium is a preferred means of improving print quality. The size of the ink droplets output by any recording apparatus (printer) using an ink jet head is determined by various factors, one of which is the size (also called "ink ejection mass") of the ink drops ejected by the ink jet head.

A technology providing plural electrostrictive means of different sizes in the ink chamber, and separately controlling and driving these electrostrictive means to eject ink droplets of various sizes, is described in JP-A-S55-79171 (1980-79171). But, when the technological concept described in JP-A-S55-79171 (1980-79171) is applied, each of the plural, different size actuators used to deform the diaphragm must be independently driven, increasing the number of wires needed, and thus making it difficult to achieve a high nozzle density. The number of drivers also increases because of the need to separately drive each actuator, and this makes it difficult to reduce the device size.

Objects of the Invention

It is, therefore, an object of the present invention to provide diaphragm vibration dampening in ink jet heads without disturbing conventional ink refill rates to maximize refill speed.

It is a further object of the present invention to provide such vibration dampening in an easily ascertainable and automatically adjustable manner which can eliminate user intervention requirements and user error.

It is yet another objection of the present invention to employ diaphragm vibration dampening in varying-size ink droplet applications while retaining high nozzle densities and relatively low manufacturing and component costs.

SUMMARY OF THE INVENTION

In accordance with these and related objects, an ink jet recording apparatus according to the present invention comprises an ink nozzle for ejecting ink drops; an ink chamber for storing ink; an ink supply path for supplying ink to the ink chamber; a diaphragm formed on an outside wall of the ink chamber, an opposing wall disposed externally to the ink chamber at a position opposing said outside wall and separated a predetermined gap distance from the diaphragm; and a diaphragm driver capable of elastically displacing the diaphragm to where it at least contacts the opposing wall. This ink jet recording apparatus also incorporates an eject signal generator for generating a first drive signal causing ink droplet ejection; a timer for counting a predetermined period from assertion and deassertion of the first drive signal, and then outputting a timing control signal in response thereto; and a complementary signal generator for supplying to the diaphragm driver according to the timing signal a second drive signal forcing the diaphragm to contact the opposing wall.

Because the diaphragm contacts the opposing wall as a result of the second drive signal supplied from the complementary signal generator, the diaphragm is held to the opposing wall with the meniscus of the ink in the ink nozzle drawn toward the inside of the ink chamber. The specific vibration period of the ink vibration system therefore becomes extremely short and the flow rate of the ink flow due to residual vibration increases, thereby causing a rapid decrease in ink system vibration due to viscous loss. Unwanted ink ejecting due to residual vibration in the ink system can thus be prevented, and the ink eject cycle shortened to accomplish high quality printing at high speed.

The timing means in this case preferably outputs the timing signal at the specific timing at which the diaphragm most closely approaches the opposing wall. This makes it possible to attract the diaphragm to the opposing wall by applying a lower voltage. Because the speed of diaphragm displacement at this timing is slow, diaphragm behavior can be consistently controlled irrespective of any variation in the specific vibration period of the ink system (i.e., even if this timing is a constant value.)

The timer may alternatively output the timing signal at a particular time period contained within the interval during which the diaphragm displaces from the position where the volume of the ink chamber is smallest toward the position where the diaphragm is closest to the opposing wall. In this case, the diaphragm begins moving at high speed toward the opposing wall at this timing, having an effect equivalent to that when the specific vibration period of the ink system is shortened, and making it possible to reduce the volume of the ejected ink droplet. In this case, therefore, the volume or size of the ejected ink drop can be varied by the timing means outputting the timing signal at one timing point selected from plural timing points contained within said period.

Also, the diaphragm driver may comprise an electrostatic actuator whereby a charge is stored between the diaphragm and opposing wall used as opposing electrodes to generate Coulomb force. This Coulomb force creates an electrostatic attraction which elastically displaces the diaphragm to the opposing wall. The electrodes are then discharged to release the diaphragm restoring force which displaces the diaphragm toward the inside of the ink chamber.

In this case, the eject signal generator comprises a charging circuit for charging the electrostatic actuator, and a first discharge circuit for discharging the electrostatic actuator at a first discharge rate. Moreover, the complementary signal generator comprises a charging circuit capable of charging the electrostatic actuator to a charge sufficient to cause contact between the diaphragm and opposing wall, and a second discharge circuit for discharging the electrostatic actuator at a second discharge rate that is slower than said first discharge rate. It is therefore possible to apply complementary charging causing the diaphragm to contact the opposing wall, and then consistently restore the diaphragm to the standby position for the next ink droplet ejecting operation, without unwanted ink ejecting and without generating vibrations in the ink system.

Other objects and attainments together with a fuller understanding of the invention will become apparent and appreciated by referring to the following description of particular preferred and alternative embodiments and claims taken in conjunction with the accompanying drawings.

BRIEF DESCRIPTION OF THE DRAWINGS

In the drawings wherein like reference symbols refer to like parts.

FIGS. 9A–9D refer to partial side cross sections of the ink jet head shown in FIG. 1, wherein FIG. 9A shows the state before ink droplet ejection, FIG. 9B shows the state when an ejection drive voltage is applied to attract the diaphragm to the opposing wall surface, FIG. 9C shows the state when the ejection drive voltage is released and the diaphragm returns toward the ink chamber, and FIG. 9D shows when the complementary charging voltage is applied to again attract the diaphragm to the opposing wall surface;

DESCRIPTION OF THE PREFERRED AND ALTERNATIVE EMBODIMENTS

Figure 1:
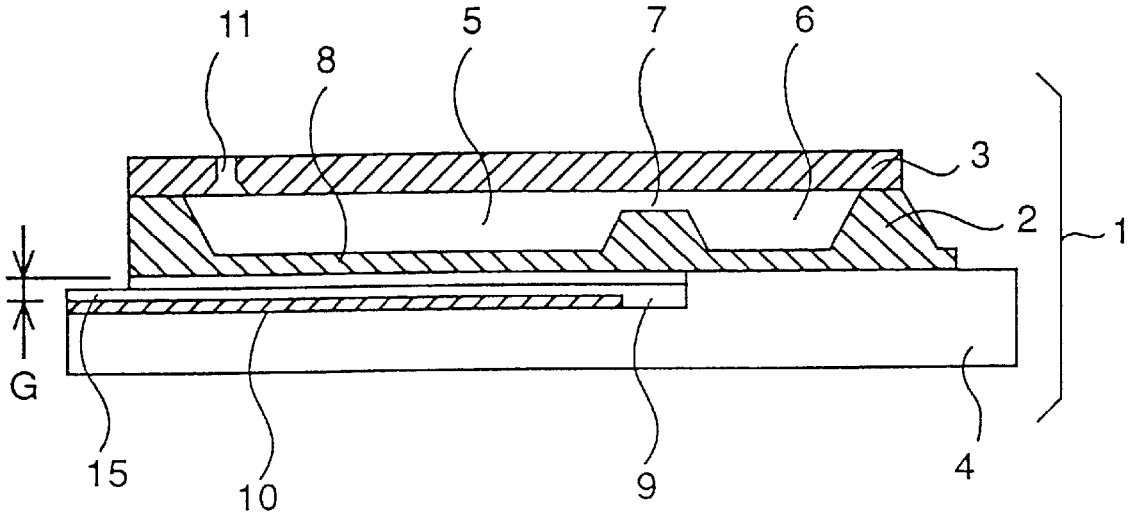
FIG. 1 is a simplified longitudinal cross section of a preferred ink jet head according to the present invention.
Figure 2:
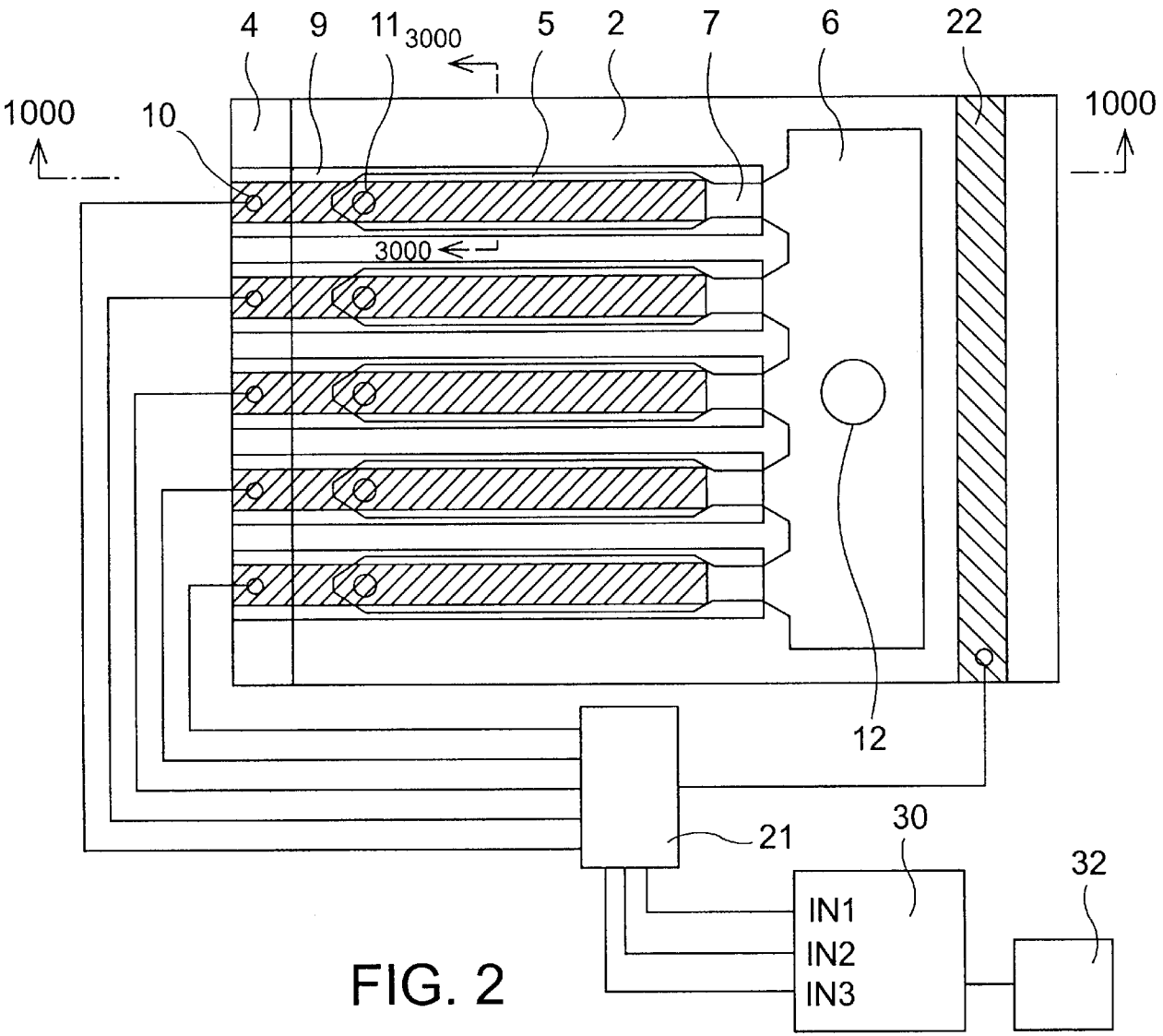
FIG. 2 is a plan view of the ink jet head shown in FIG. 1.

FIG. 1 is a cross section of a preferred ink jet head according to the present invention, FIG. 2 is a partial plan view thereof, and FIG. 3 is a partial cross section thereof.

As shown in these Figs., ink jet head 1 comprises a three-layer lamination in which a silicon nozzle plate 3 is disposed above, and a borosilicate glass substrate 4 with a thermal expansion coefficient close to that of silicon is disposed below, along with a center silicon substrate 2. Plural independent ink chambers 5, common ink chamber 6 preferably shared by all ink chambers 5, and ink supply paths 7 connecting common ink chamber 6 to each of the independent ink chambers 5, are formed in the center silicon substrate 2 by etching channels corresponding to each of these components in the surface of silicon substrate 2 (i.e., the top surface as seen in FIG. 1). After etching, nozzle plate 3 is bonded to the surface of silicon substrate 2 to finish forming the various ink chambers and ink supply paths.

Ink nozzles 11, which open into the corresponding ink chambers 5, are formed in nozzle plate 3 at positions corresponding to the end of each ink chamber 5. Ink supply port 12 (see FIG. 2) continuous with common ink chamber 6 is also formed in nozzle plate 3. Ink is thus supplied from an external ink tank (not shown) through ink supply port 12 to common ink chamber 6. The ink stored in common ink chamber 6 then passes through ink supply paths 7, and is supplied to each of the independent ink chambers 5.

Ink chambers 5 are formed with a thin bottom wall 8 to function as a diaphragm elastically displaceable in the vertical direction as shown in FIG. 1. To simplify the description of this bottom wall 8 herein below, bottom wall 8 may also be referred as diaphragm 8.

Figure 3A:
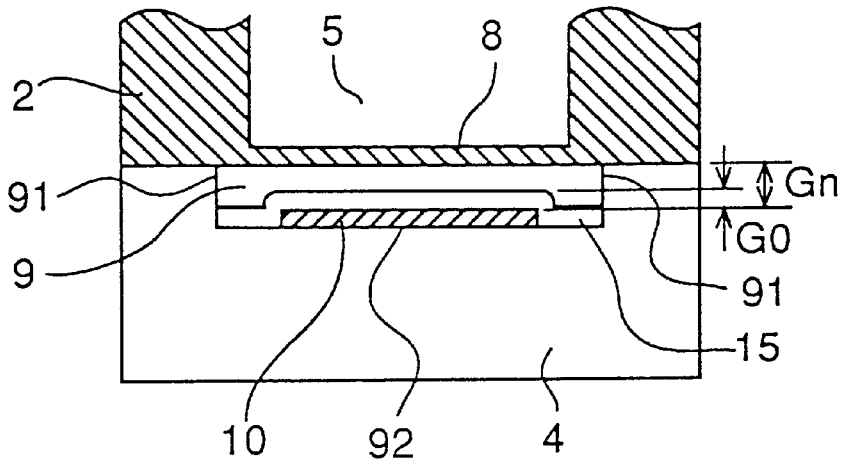
FIGS. 3A–3C are simplified side cross sections used to describe the operation of the embodiment of an ink jet head shown in FIG. 1 with FIG. 3A showing the standby state, FIG. 3B showing when ink is supplied, and FIG. 3C showing the state when the ink is compressed or pressurized.
Figure 3B:
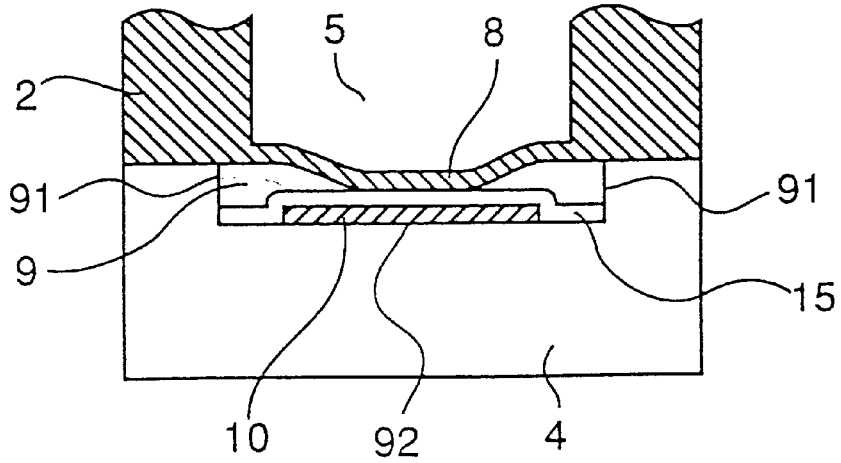
Figure 3C:
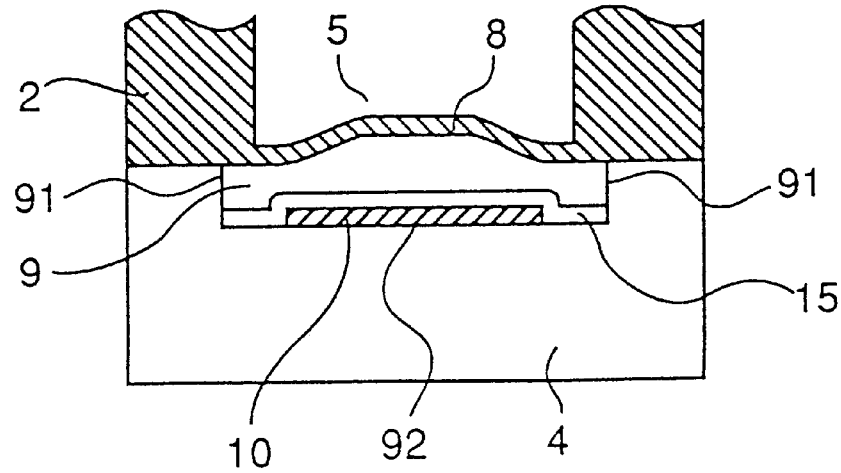

On the top surface of glass substrate 4 contacting the bottom of silicon substrate 2 are formed shallow etched recesses 9 at positions corresponding to each of the ink chambers 5 in silicon substrate 2. As a result, bottom wall 8 of each ink chamber 5 faces surface 92 (FIGS. 3A–3C) in the bottom of recess 9 of glass substrate 4 with an extremely narrow gap therebetween. Because recesses 9 of glass substrate 4 are disposed opposite bottom walls 8 of ink chambers 5, recesses 9 are referred to as the diaphragm-opposing wall, or simply opposing or stationary wall 91 (FIGS. 3A–3C).

The bottom wall 8 of each ink chamber 5 functions in this embodiment as an electrode storing a charge. An electrode segment 10 is also formed on recess surface 92 of glass substrate 4 opposing bottom wall 8 of each ink chamber 5. The surface of each electrode segment 10 is covered by a glass insulation layer 15 of thickness G0 (see FIG. 3A). As a result, electrode segment 10 and bottom wall 8 of each ink chamber form opposing electrodes separated by insulation layer 15 and having an electrode gap of G.

As shown in FIG. 2, drive circuit 21 for driving the ink jet head charges and discharges the opposing electrode gaps according to a print signal applied from an external source (not shown in the Figs.). One output of drive circuit 21 is connected directly to each electrode segment 10, and the other output is connected to common electrode terminal 22 formed in silicon substrate 2.

Impurities are implanted to silicon substrate 2, which is thus made conductive and therefore capable of supplying a charge from common electrode terminal 22 to bottom wall 8. Note that when it is necessary to supply a voltage to the common electrode with low electrical resistance, a thin-film of gold or other conductive material can be formed by vapor deposition, sputtering, or other process on one surface of the silicon substrate as is known in the art. Silicon substrate 2 and glass substrate 4 are bonded by an anodic bond in this embodiment, and a conductive film is therefore formed on the surface of silicon substrate 2 in which the ink supply paths are formed.

A cross section through line 3000—3000 in FIG. 2 is shown in FIGS. 3A–3C. When a drive voltage is applied from drive circuit 21 to the opposing electrode gap, the Coulomb force generated in the opposing electrode gap deflects bottom wall (diaphragm) 8 toward electrode segment 10, thereby increasing the capacity or volume of ink chamber 5 (FIG. 3B). When the charge stored to the opposing electrode gap is then rapidly discharged by drive circuit 21, bottom wall 8 returns to the original position due to the resiliency or restoring force of the material, thus rapidly reducing the volume of ink chamber 5 (FIG. 3C) and increasing the pressure. The pressure thus generated inside the ink chamber by the return of bottom wall 8 forces part of the ink stored in ink chamber 5 to be ejected as an ink droplet from the ink nozzle 11 leading from that ink chamber.

Figure 4:
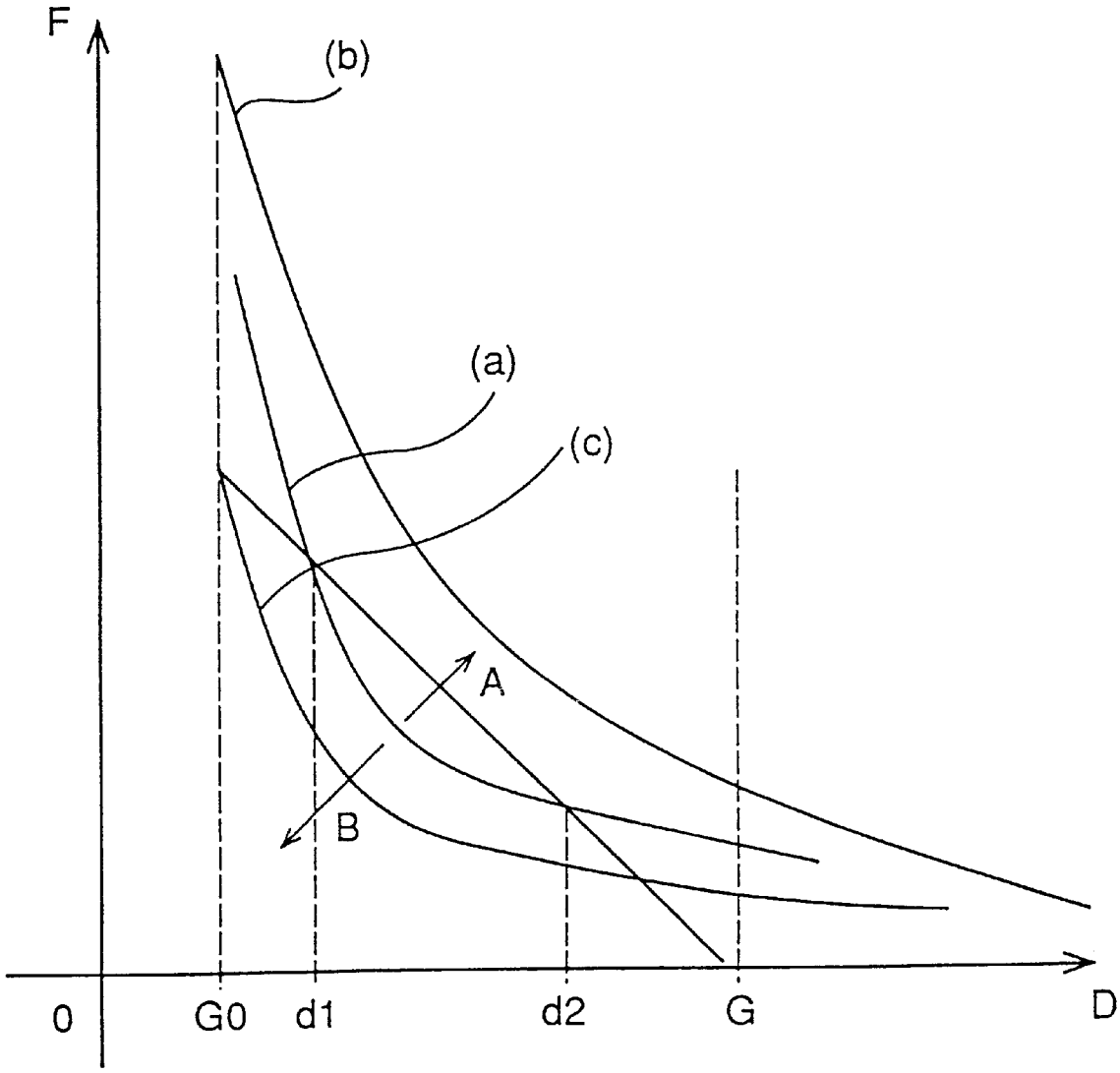
FIG. 4 is a graph showing the relationship between diaphragm gap distance and the force acting on the diaphragm, and is used to describe the operation of an ink jet head according to the present invention.

The relationship between the voltage applied to the opposing electrode gap and the behavior of bottom wall 8 is described next with reference to FIG. 4. FIG. 4 is a graph showing the relationship between the distance between diaphragm 8 and electrode segment 10 versus the force acting on diaphragm 8 when diaphragm 8 is displaced.

The restoring force of diaphragm 8 is shown by a solid right slanting straight line in FIG. 4. Note that the restoring force of diaphragm 8 increases in a linear fashion proportionally to the displacement as diaphragm 8 is deformed (displaced) from the position of gap length G toward the electrode segment. The slope (absolute value) of the restoring force curve expresses the compliance; as compliance increases, the slope decreases. The curves (a), (b) and (c) in FIG. 4 indicate the Coulomb force generated in the opposing electrode gap; the Coulomb force is inversely proportional to the square of the opposing electrode gap for any constant applied voltage. Because the Coulomb force is proportional to the square of the applied voltage, curve (a) shifts in the direction of arrow A as the applied voltage increases, and arrow B as the applied voltage decreases.

G0 in FIG. 4 refers to the thickness of insulation layer 15 shown in FIG. 3A. At this position diaphragm 8 physically contacts the opposing wall. Values d1 and d2 indicate where the restoring force of diaphragm 8 and the Coulomb force acting on the opposing electrode gap are balanced, d1 being an unstable balance point and d2 being a stable balance point. More specifically, when a constant voltage is applied, diaphragm 8 displaces from G to d2 and stops. If external force is thereafter applied and diaphragm 8 displaces to a position between d2 and d1, diaphragm 8 will simply return to d2 again when that external force is released. However, if diaphragm 8 is displaced by an external force beyond d1 to a point near the electrode segment, diaphragm 8 will displace to the contact position, i.e., to G0, and this contact will be retained even after the external force is released.

A high voltage shown in FIG. 4 as curve (b) is applied to the opposing electrode gap to force diaphragm 8 to contact the opposing wall. When this voltage is applied, there are no balance points d1 and d2, and diaphragm 8 is immediately displaced to the contact position GO. It is to be noted that displacement of diaphragm 8 can be forced to overshoot d1 by suddenly re-applying a voltage after applying a voltage lower than this high voltage if the distance between d1 and d2 is sufficiently small. It is therefore also possible to force diaphragm 8 to the contact position using a lower voltage.

To next return diaphragm 8 to the original position, the applied voltage is discharged or otherwise dropped to a low voltage shown as curve (c) in FIG. 4. This causes diaphragm 8 to begin moving toward the stable balance point d2 at a rate of acceleration determined by the difference between the diaphragm restoring force and the Coulomb force. As a result, if the applied voltage is dropped with sufficient speed, the restoring acceleration of diaphragm 8 will be sufficient to propel the ink drops. Likewise, if the applied voltage is lowered gradually, the restoring acceleration of diaphragm 8 can be suppressed to prevent ejecting any ink drops.

The compliance of diaphragm 8 is described next.

Because a volume change in the ink chamber is effected by deforming the diaphragm, the compliance of diaphragm 8 is defined here as the amount of volume change in the ink chamber resulting from unit pressure acting on the diaphragm 8.

Figure 5:
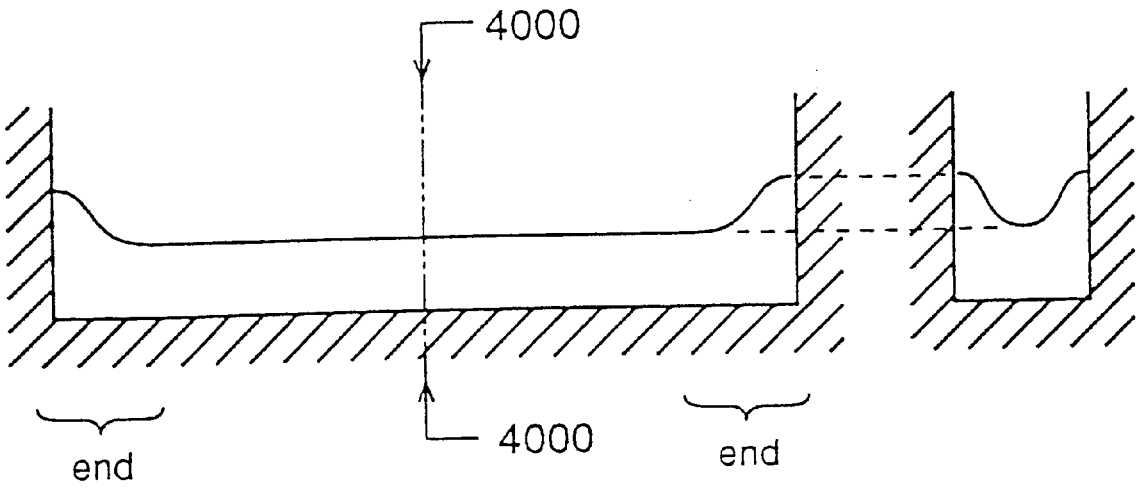
FIG. 5 is used to describe an alternative embodiment of the diaphragm of the ink jet head according to the present invention.

Note that in order to narrow the ink nozzle pitch, diaphragm 8 is designed with the smallest possible dimension in the direction in which the ink nozzles are arrayed (up and down as seen in FIG. 2; the diaphragm "width" hereafter), and a large dimension in the direction perpendicular to the width (hereafter, the diaphragm "length"), e.g., a 3 mm length for a 200 micrometer width in this example. As a result, the rigidity across the width of diaphragm 8, except at the ends in the lengthwise direction of diaphragm 8, controls the amount of deformation in diaphragm 8 when an equally distributed load (pressure or Coulomb force) acts on diaphragm 8 as shown in FIG. 5. The following relationship can therefore be defined between the shape and compliance (Cm) of diaphragm 8:

$$Cm=K*L*(W^5/T^3)$$

where K is a constant, and L, W, and T are the length, width, and thickness, respectively, of diaphragm 8. As this equation shows, the compliance (Cm) of diaphragm 8 is proportional to the length (L), proportional to the fifth power of the width, and inversely proportional to the cube of the thickness (T), of diaphragm 8.

It will also be obvious that the compliance of diaphragm 8 when diaphragm 8 is in contact with the opposing wall can be considered equal to zero. This is because even if only a third of the width in the center of diaphragm 8 contacts the opposing wall, the compliance will be less than 1/100th because compliance is proportional to the fifth power of the width.

The preferred and alternative embodiments of the present invention are therefore described hereinbelow against this background.

A drive circuit suitable as the voltage application means 21 used to apply a voltage and thus drive an ink jet head constructed as described above is described below with reference to FIG. 6, a circuit diagram of the drive circuit, and FIGS. 7A–7D collectively show a timing chart of drive circuit operation. Input signals IN1, IN2 and IN3 are applied to drive circuit 21 from signal generator 30 in the sequence dictated by timer 32 (FIG. 2) as shown in the timing chart of FIGS. 7A–7D.

Figure 6:
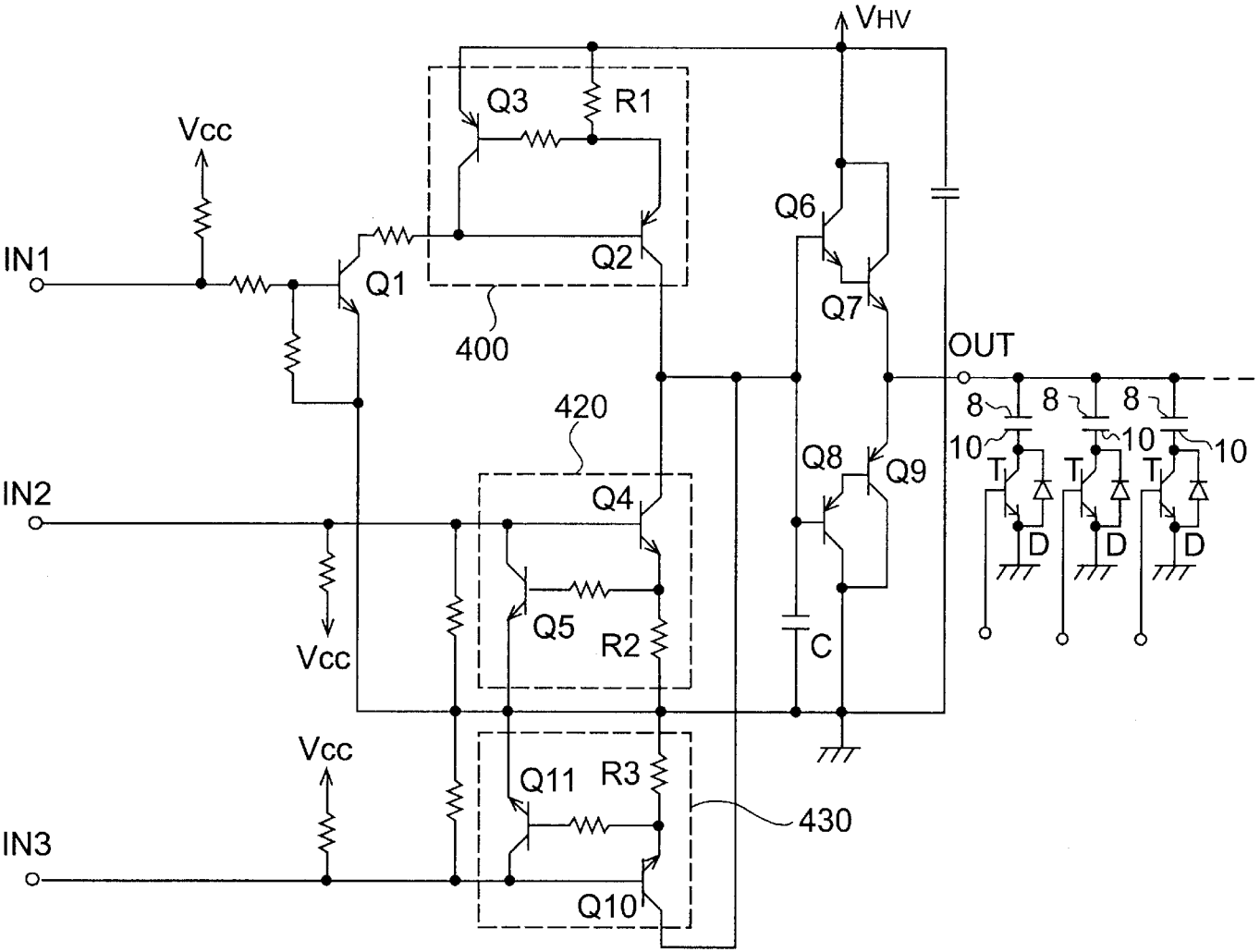
FIG. 6 is a circuit diagram of one example of a drive circuit used in connection with the ink jet head shown in FIG. 1.

Charge signal IN1 in FIG. 6 is used to accumulate a charge between the opposing electrodes (diaphragm 8 and electrode segment 10) to displace diaphragm 8, and is input through level-shift transistor Q1 to first constant current circuit 400. First constant current circuit 400 comprises primarily transistors Q2 and Q3, and resistor R1, and charges capacitor C with a constant current value τ1.

First discharge signal IN2 is used to discharge the charge stored to the charged opposing electrodes, and thus restore diaphragm 8 to the standby (non-displaced) state. Second constant current circuit 420 comprises primarily transistors Q4 and Q5, and resistor R2, and is configured to discharge the charge stored to capacitor C at a constant discharge rate τ2 during the period in which first discharge signal IN2 is ACTIVE.

Second discharge signal IN3 is used to discharge the charge stored to the charged opposing electrodes to restore diaphragm 8 to the standby state. Third constant current circuit 430 configured primarily transistors Q10 and Q11, and resistor R3, the resistance of which is greater than that of resistance R2. Third constant current circuit 430 is comprised to discharge the charge stored to capacitor C at a constant discharge rate τ3 that is slower than the discharge rate τ2 of second constant current circuit 420 during the period in which the second discharge signal IN3 is ACTIVE.

The terminals of capacitor C are connected to the output terminal OUT via a buffer comprising transistors Q6, Q7, Q8, and Q9. The common electrode terminal 22 of the ink jet head is also connected to the output terminal OUT, and the output of transistor T is connected to the respective electrode segment 10.

While charge signal IN1 is active, capacitor C is charged to a constant current level. If the transistor T corresponding to the electrode segment of the nozzle from which a droplet is to be ejected is also on at this time, the corresponding opposing electrode gap will be charged to the same voltage level as the capacitor C. Because the capacitor C is discharged when the discharge signal is input, the charge stored to the charged electrode gap is discharged through the corresponding diode D.

The operation of a drive circuit thus comprised is described further below with reference to the timing chart in FIGS. 7A–7D.

When charge signal IN1 (FIG. 7A) becomes active, the leading edge of the charge signal sequentially turns on transistor Q1 and transistor Q2 of first constant current circuit 400. Capacitor C is thus charged using a constant current value determined by resistance R1.

Figure 7:
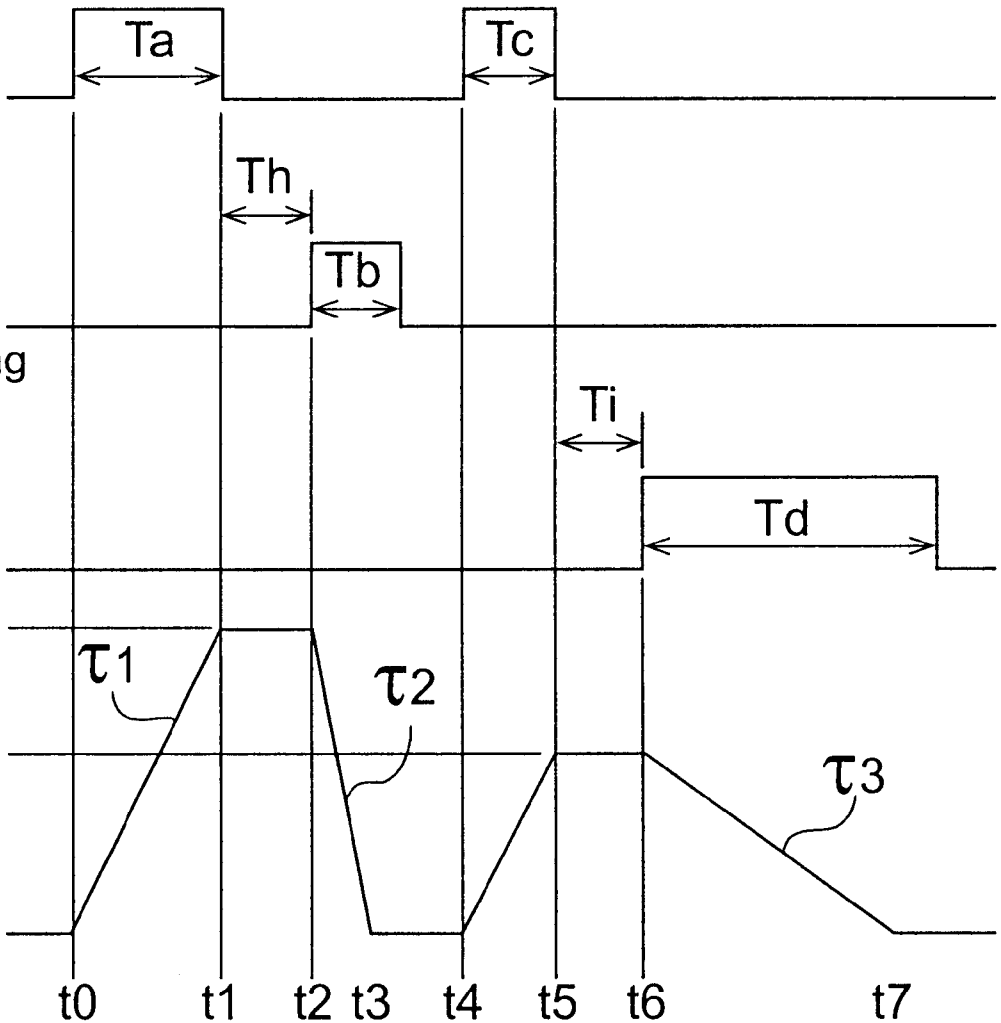
FIGS. 7A–7D depict is a signal timing chart used to describe the operation of the drive circuit shown in FIG. 6.

The terminal voltage of capacitor C thus rises linearly from 0 volt with a constant slope τ1 as shown in FIG. 7D during the period from time t0 to time t1 (FIG. 7D). This slope t1 is determined by the resistance of resistor R1, and the electrostatic capacity of capacitor C. A slow charge rate can therefore be set for capacitor C and the opposing electrodes connected thereto through the buffer by increasing the resistance of resistor R1. This charge rate is determined with consideration given to, for example, the ink supply rate to the ink chamber. Ink thus flows from common ink chamber 6 into ink chamber 5 through the ink supply path because diaphragm 8 is displaced toward electrode segment 10, and ink chamber 5 expands.

When charge signal IN1 becomes inactive after time Ta has passed (at time t1), transistors Q1 and Q2 turn off and charging of capacitor C thus stops. The voltage stored to the opposing electrode gap is thus held at voltage V0 at time t1, and diaphragm 8 stops in contact with electrode segment 10.

When a predetermined period Th then passes, first discharge signal IN2 (for ink droplet ejecting) becomes active (FIG. 7B) at time t2. Transistor Q4 of second constant current circuit 420 thus discharges the charge stored to capacitor C during period Tb at a rate determined by resistor R2. The voltage between the terminals of capacitor C thus drops linearly with slope τ2 based on the resistance of resistor R2.

Note that the duration of period Tb (time t2 to t3) is sufficient to completely discharge the charge held by capacitor C for a given R2. When first discharge signal IN2 for ink ejecting becomes inactive at time t3, transistor Q4 turns off, discharging by second constant current circuit 420 stops, and the terminal voltage of capacitor C, i.e., the voltage stored to the opposing electrodes, is held to zero.

When charge signal IN1 again becomes active at timing point t4, capacitor C is again charged to a specified voltage V1 determined by the length of active period Tc, and voltage V1 is thereafter held for period Ti from time t5 to t6. When second discharge signal IN3 (complementary) then becomes active at time t6 following period Ti, transistor Q10 of third constant current circuit 430 turns on, thus causing the charge in capacitor C to start discharging through resistor R3.

The resistance of resistor R3 is greater than the resistance of resistor R2, causing the voltage between the terminals of capacitor C to drop linearly but on a more gradual slope t3 (i.e., at a slower rate) than when ejecting ink as described in reference to period t2–t3 described hereinabove. Note that period Td (t6 to t7) during which the second discharge signal is active is set with consideration given to the ink eject frequency and the time required to completely discharge the opposing electrode charge.

A drive method for an ink jet head using a drive circuit as described above is described next below. The control method used after the drive voltage applied to the opposing electrode gap by voltage application means 21 is canceled is described in particular.

Figure 8:
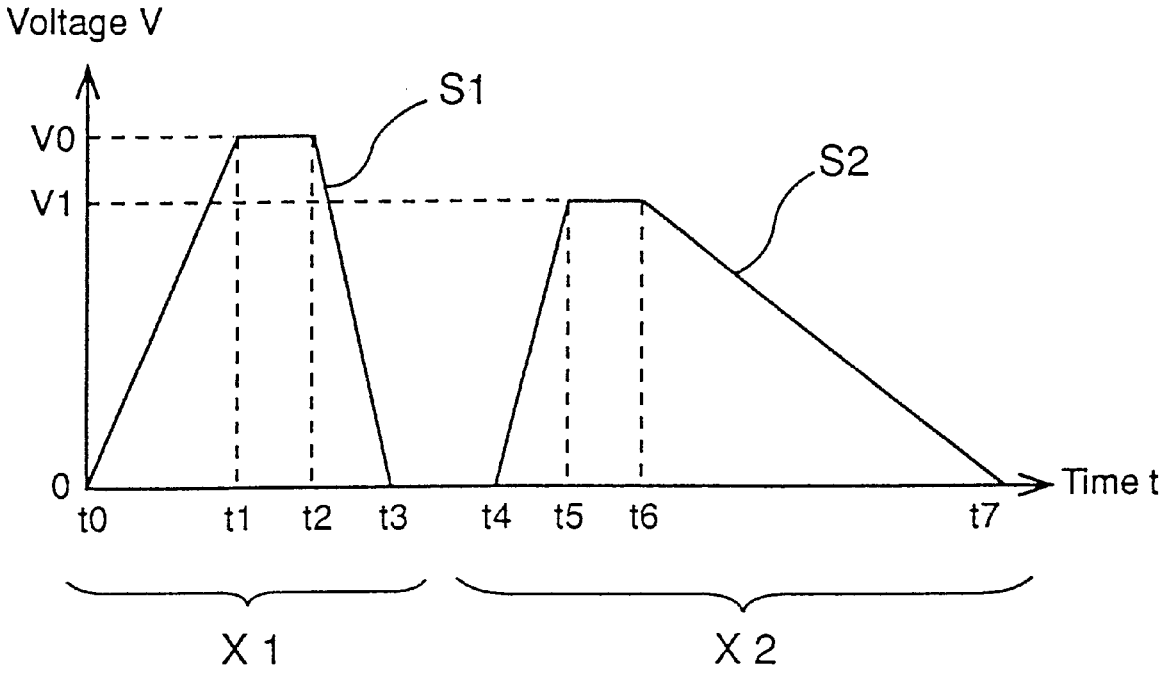
FIG. 8 is a signal waveform diagram showing an embodiment of the drive signal used to drive the ink jet head shown in FIG. 1.

FIG. 8 shows one example of the voltage waveform between the opposing electrodes. The opposing electrode gap is charged so that the gap voltage rises to a peak voltage V0 at time t1, and the peak voltage V0 is then held to time t2. The gap voltage is then discharged from time t2 as described below to eject ink (charging/discharging interval X1 for ink ejecting).

After a defined period from time t3 at which discharging is completed, complementary charging/discharging interval X2 is accomplished from time t4 to time t7. Note that peak voltage V1 of the complementary charging/discharging interval X2 is lower than peak voltage V0 above. The discharge slope S2 during the discharge interval of complementary charging/discharging period X2 (the period from time $\tau 6$ to $\tau 7$) is set to be sufficiently lower (a slower discharge rate) than the slope S1 (the slope of the period from time t2 to t3) of the discharge period of charging/discharging interval X1 (see FIGS. 7A–7D).

Figure 9A:
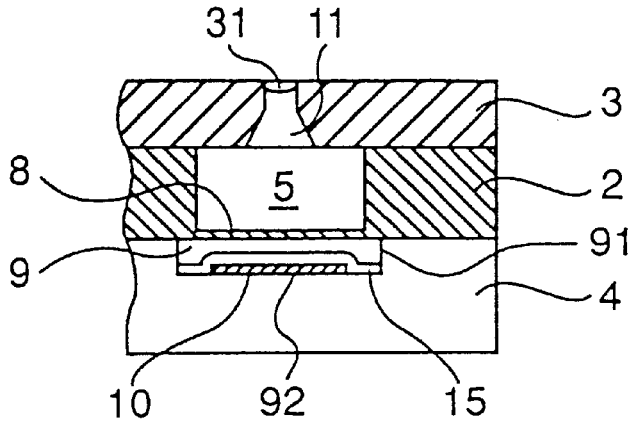
Figure 9B:
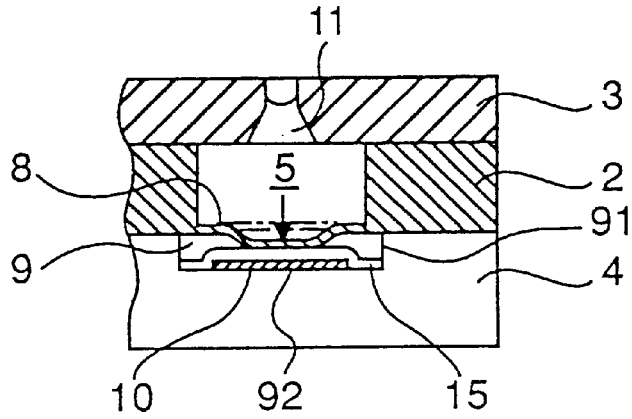
Figure 9C:
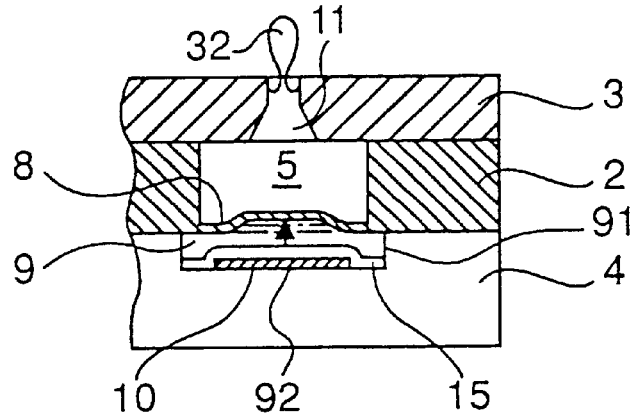

Charging and discharging are thus executed twice during the ink droplet ejecting operation. The state immediately before charging is shown in FIG. 9A. Note that ink surface 31 (i.e., the ink meniscus) is located near the nozzle opening of ink nozzle 11. When charging in charging/discharging period X1 starts from this state, diaphragm 8 is attracted to electrode segment 10 provided on opposing wall surface 92, and thus contacts the surface of insulation layer 15. FIG. 9B shows diaphragm 8 in contact with insulation layer 15. Displacement of diaphragm 8 to insulation layer 15 thus increases the capacity of ink chamber 5, creating negative pressure in ink chamber 5 pulling ink surface 31 in toward ink chamber 5. When period X1 charging stops, ink flows into the ink chamber through ink supply path 7, and the pressure created by the ink flow inertia accumulates in the ink chamber. Discharging is started when the ink pressure has increased to a sufficient level at time t2. When the opposing electrode gap voltage drops from peak voltage V0 to a predetermined voltage level, diaphragm 8 is released and is elastically displaced in the opposite direction, i.e., upward as seen in FIG. 9C, by the elastic restoring force of the diaphragm. This elastic displacement works with the pressure created by the ink flow inertia to cause a rapid rise in the internal pressure of the ink chamber, breaking the surface tension of the meniscus and causing ink drop 32 to be ejected from ink nozzle 11 as shown in FIG. 9C.

The residual vibration of both ink and diaphragm remaining in the ink chamber after ink droplet ejecting cause diaphragm 8 to elastically displace again toward the opposing wall. At this point, conventional ink jet head drive methods do nothing to specifically dampen the vibration of diaphragm 8, and diaphragm vibration is thus simply and naturally attenuated by the viscosity resistance of the ink.

Figure 9D:
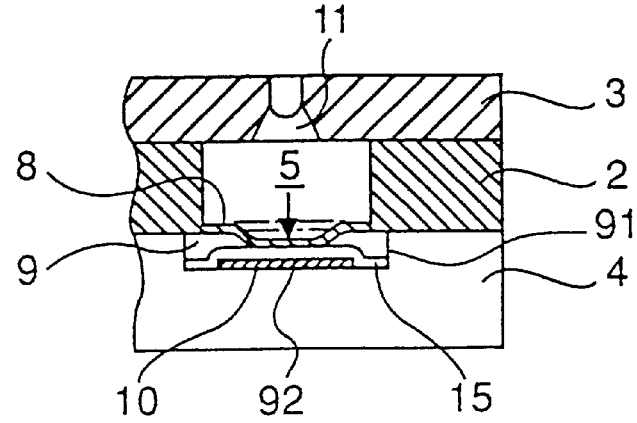

The method of the present invention, however, starts complementary charging period X2 to dampen vibrations at the point at which diaphragm 8 moves closest to the opposing wall. The peak voltage V1 used at this time is lower than the peak voltage V0 used during ink droplet ejecting, but results in a strong force of attraction because the charge is applied when diaphragm 8 is in contact with or nearly in contact with the opposing wall. Diaphragm 8 is thus again held temporarily in contact with surface 92 (FIG. 9D). The displacement speed of the diaphragm at approximately the time when peak voltage V1 is applied is near zero, and there is therefore little change in the distance to the opposing wall even if the timing t4 at which complementary charging starts is offset slightly from the point at which the diaphragm approaches closest to the opposing wall due to, for example, temperature changes affecting the specific vibration period of the ink system.

After diaphragm 8 is elastically displaced to eject ink droplets, the control method of the invention as thus described forcibly constrains diaphragm displacement when the diaphragm has displaced to the position of greatest ink chamber capacity, and thereby prevents unwanted vibration. The compliance of the diaphragm thus drops rapidly, and the specific vibration period of the ink system is extremely short. The ink flow rate inside the ink chamber and the ink supply path therefore rises, accelerating consumption of residual vibration energy. The result is a rapid drop in residual vibration in the ink system.

It is to be noted that the peak pressure inside the ink chamber resulting from residual vibration of the ink system rises rapidly, but does not rise sufficiently to cause ink ejecting. This is because the diaphragm stops in contact with the opposing wall, i.e., where the ink chamber capacity is greatest, and the ink surface inside the nozzle is pulled closest in toward the ink chamber.

If the charge in the opposing electrode gap is rapidly discharged from this state, diaphragm 8 will return from the opposing wall surface 92 as during ink ejecting, and will therefore move inside the ink chamber. Such elastic displacement of diaphragm 8 can, therefore, create a rapid increase in the internal ink chamber pressure, potentially resulting in ejecting undesirable ink droplets from ink nozzle 11.

The method of the present invention prevents this by gradually discharging the complementary charge of complementary charging/discharging period S2, preventing diaphragm 8 from accelerating to a velocity sufficient to cause ink droplet ejecting. There is, therefore, no ejecting of unnecessary ink droplets, and unnecessary ink system vibrations resulting from ink droplet ejecting are also reduced. Complementary charging/discharging period X2 thus results in effective attenuation of overall residual vibration.

An alternative embodiment of an ink jet head is described next with reference to FIG. 10. In ink jet head 1A shown in FIG. 10, the gap G between diaphragm 8 and opposing wall surface 92 varies in a stepped pattern descending lengthwise with respect to the ink chamber. Ink jet head 1A is otherwise identical to ink jet head 1 of the first embodiment above. Identical parts are therefore identified by like reference signs, and accordingly, further description thereof is omitted herein below.

Figure 10:
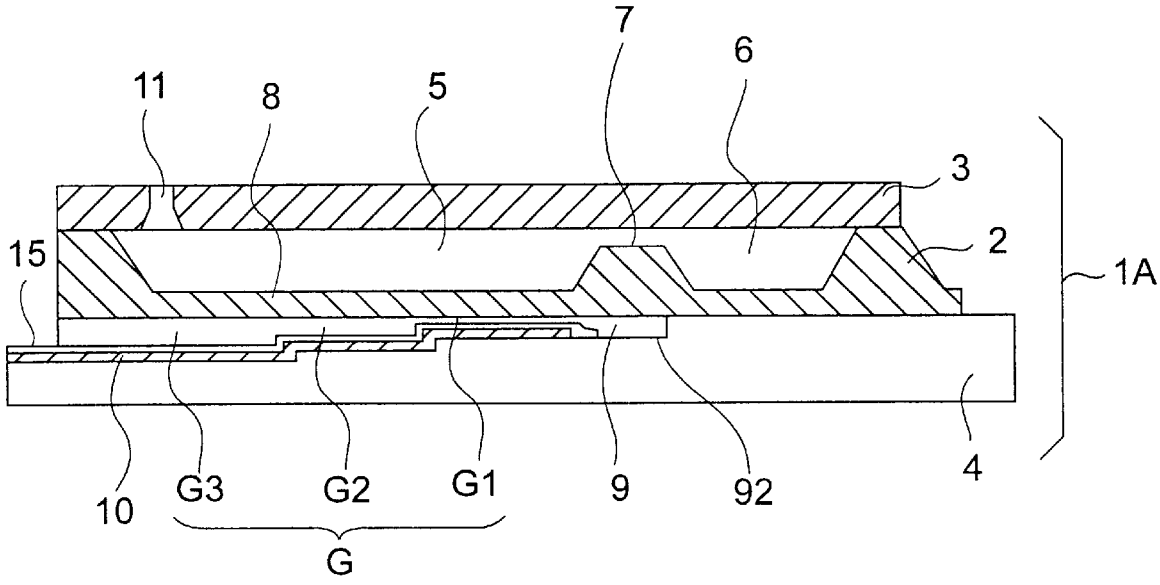
FIG. 10 is a simplified side cross section of an ink jet head according to an alternative embodiment of the present invention.

As shown in FIG. 10, the back of each diaphragm 8 is flat while opposing wall surface 92 of glass substrate 4 is formed in a stepped pattern descending lengthwise with respect to ink chamber 5. This stepped pattern results in plural gaps of gradually increasing size between glass surface 92 and diaphragm 8. The smallest gap G1 is formed at the end of ink chamber 5 nearest ink supply path 7, i.e., between the diaphragm and the first step of opposing wall surface 92. Adjacent to gap G1 in the middle of diaphragm 8 is formed a second gap G2 greater than gap G1. The third gap G3 formed closest to ink nozzle 11 is the greatest gap between opposing wall surface 92 and diaphragm 8. These gaps are, more accurately, the electrical gaps defined by the distance from the top surface of electrode segment 10 to the bottom of diaphragm 8 as shown in FIGS. 3A–3C.

By thus varying this gap G, the gradual drop in the voltage between opposing electrodes during the discharge interval of the complementary charging/discharging period S2 following charging/discharging period S1 for ink droplet ejecting (FIG. 8) causes diaphragm 8 to separate gradually from opposing wall surface 92. More specifically, diaphragm 8 separates partially and sequentially from surface 92 starting from the part thereof where the gap is greatest (G3), and proceeding to the part where the gap is smallest (G1). Because diaphragm 8 is released from surface 92 in parts and not at once, unnecessary ink droplet ejecting and unnecessary ink vibration can be even more reliably suppressed, and residual vibration after ink droplet ejecting can be rapidly and consistently damped.

When the rigidity of diaphragm 8 is varied continuously lengthwise relative to ink chamber 5, the same effect described above can be obtained, i.e., diaphragm 8 contacting opposing wall surface 92 can be consistently returned to the standby state without causing ink droplets to eject.

Figure 11:
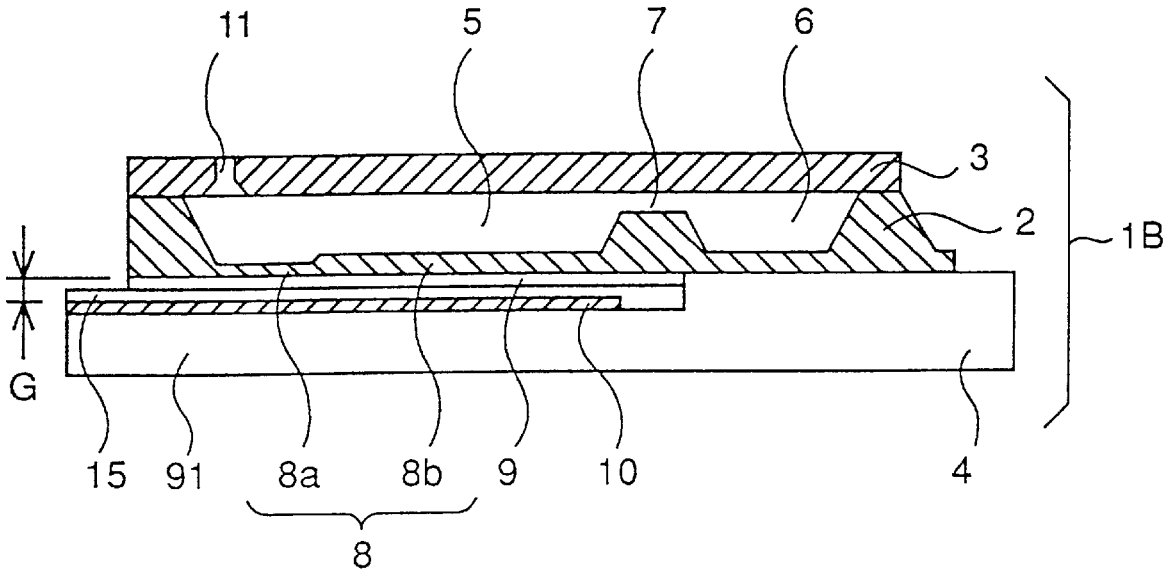
FIG. 11 is a simplified side cross section of an ink jet head according to a further alternative embodiment of the present invention.

An ink jet head of this construction is described below with reference to FIG. 11. In this ink jet head 1B, the part of diaphragm 8 on the side nearest ink nozzle 11 at the end of the ink chamber is a thin, plate-like, low rigidity member 8*a*. In contrast to FIG. 11, low rigidity member 8*a* need not be formed with an obvious demarcation between the thickness of low rigidity member 8*a* and the other parts of diaphragm 8, and diaphragm 8 may be formed with the thickness thereof gradually tapering lengthwise relative to the ink chamber positioned thereabove.

Figure 12:
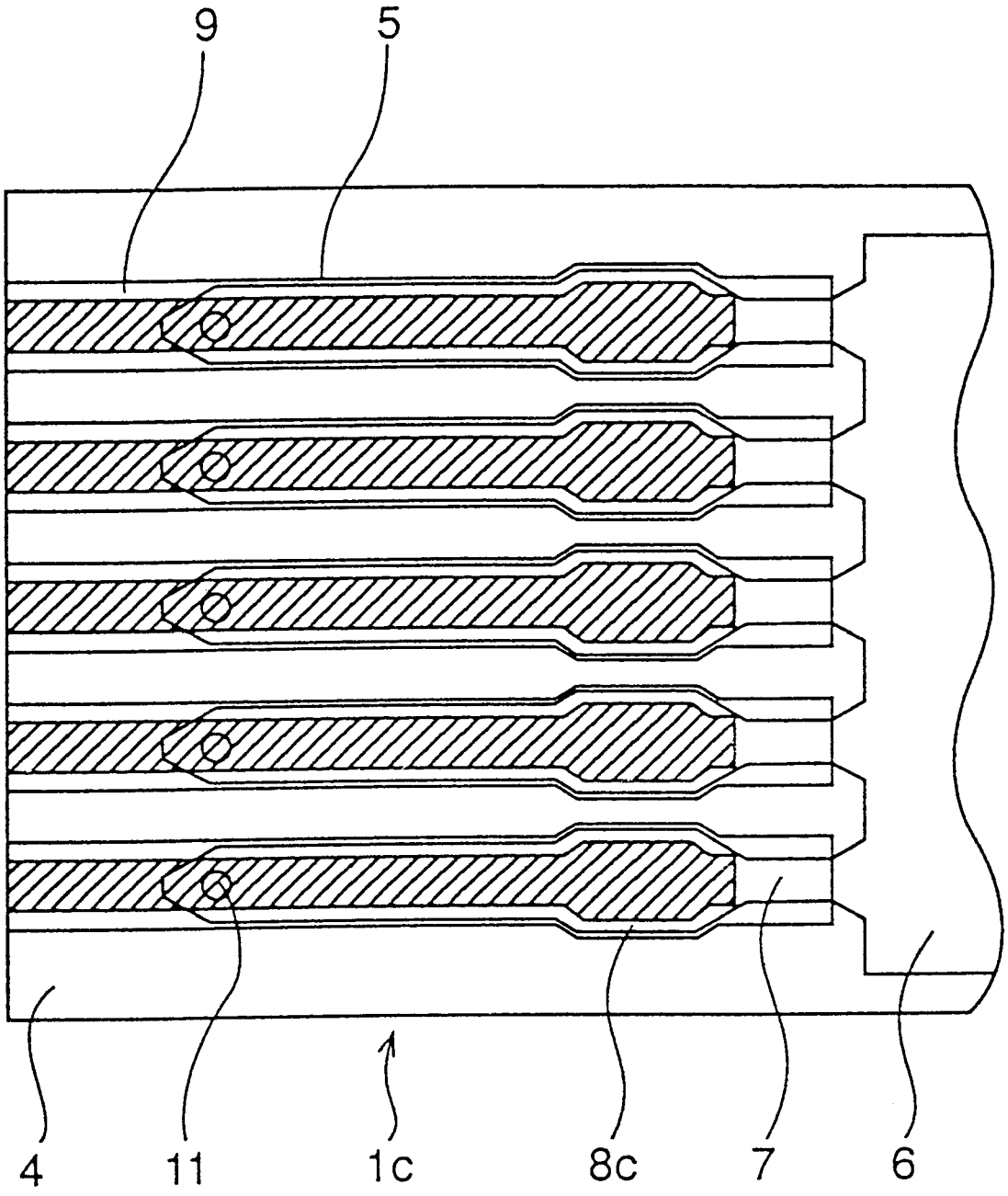
FIG. 12 is a plan view of an ink jet head shown in FIG. 11.

A further embodiment of an ink jet head in which the rigidity of diaphragm 8 is varied is shown in FIG. 12. In this ink jet head 1C, the base end (near ink supply path 7) of the ink chamber is wider than the rest of the ink chamber. The width of diaphragm 8 is also increased in the corresponding area to form low rigidity member 8*c*. As with the diaphragm thickness above, low rigidity member 8*c* need not be formed with an obvious demarcation between the width of low rigidity member 8*c* and the other parts of diaphragm 8, and diaphragm 8 may be formed with the width thereof gradually tapering lengthwise to the ink chamber.

When the opposing electrode gap charge is gradually discharged with these alternative configurations, the diaphragm separates from the opposing wall starting from the relatively high rigidity part thereof and proceeding to the low rigidity part. The entire diaphragm is therefore not restored at the same time, and the effects obtained by gradually discharging the opposing electrode gap as described above can be obtained with even greater reliability.

Figure 13:
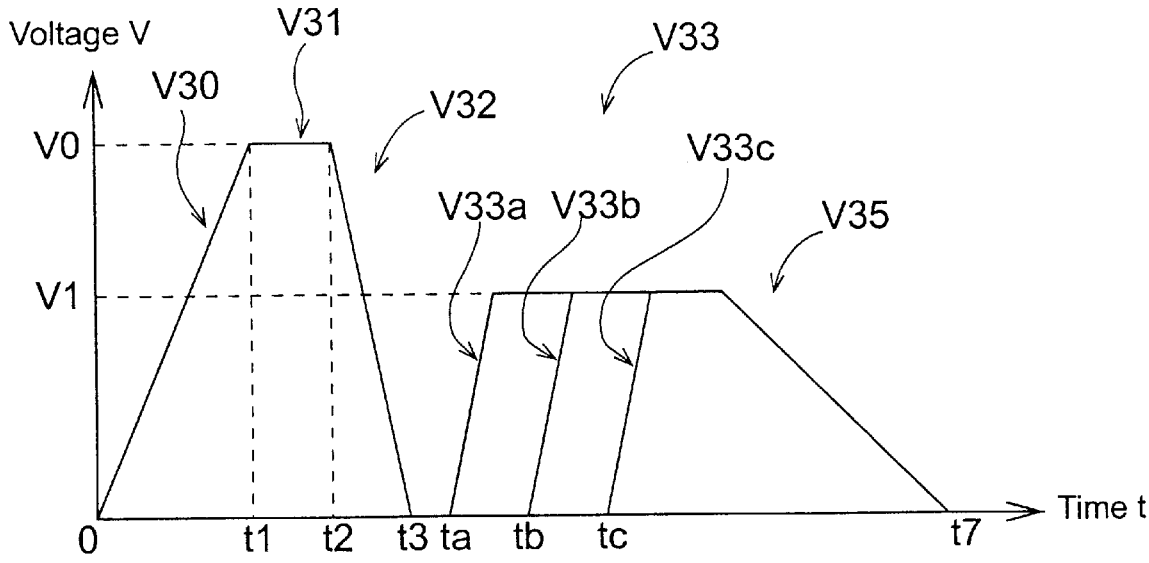
FIG. 13 is an alternate signal waveform showing an alternative embodiment of the drive signals suited for driving the ink jet head according to the presently preferred and alternative embodiments of the present invention.

An alternative printing apparatus drive method according to the present invention is described below. FIG. 13 shows an alternative voltage wave applied to the opposing electrode gap and particularly appropriate for driving ink jet head 1 shown in FIG. 1. Charging/discharging occurs twice in this embodiment: charging/discharging from V30 to V32 for ink droplet ejecting, and charging/discharging from V33 to V35 controlling the ink droplet eject volume. Thus, complementary charging/discharging from V33 to V35 occurs after charging/discharging from V30 to V32 for ink droplet ejecting.

The opposing electrode gap is first charged to peak voltage V0, attracting diaphragm 8 to contact opposing wall 91. When this charge is then discharged, i.e., after time t2 in FIG. 13, diaphragm 8 is returned toward the original non-charged standby position by the elastic restoring force thereof, and is thus displaced beyond the standby position into ink chamber 5. This rapidly pressurizes the ink in ink chamber 5, causing an ink drop to be ejected from ink nozzle 11.

Complementary charge V33 is then applied when the ink drop is ejected completely from ink nozzle 11, i.e., at a point between ta and tc preceding ink drop separation. The resulting Coulomb force attracts the complete diaphragm 8 toward opposing wall 91, causing great elastic displacement. This causes a sudden temporary drop in the ink pressure inside the ink chamber, and this acts to pull the ink drop into the ink chamber. As a result, the volume of the ejected ink drop is greatly reduced, a fine ink drop is ejected, and a small droplet is formed on the recording medium (paper). This action can be considered identical to the ink drop ejecting operation of an ink jet head wherein the compliance of diaphragm 8 is low and the specific vibration period of the ink system is particularly short as described above.

It is therefore possible to change the specific vibration period of the ink vibration system by controlling the point at which complementary charging V33 starts. It is theoretically therefore also possible to control the ink droplet eject volume.

Starting complementary charging V33 (V33*a*) at the earliest point ta after discharging V32 is completed is equivalent to operating with an extremely short specific vibration period in the ink system. The ejected ink volume is therefore greatly reduced, and fine ink drop ejecting can be achieved. Conversely, if complementary charging V33 (V33*c*) starts at the latest possible point tc, there is minimal real change in the specific vibration period of the ink system. The ink droplet eject volume is therefore relatively great, and a large droplet is formed. If complementary charging V33 (V33*b*) starts at some point between the earliest (ta) and latest (tc) points, the ink droplet eject volume is between the smallest (V33*a*) and largest (V33*c*) levels. It is therefore possible to control the ink droplet eject volume by changing the start of complementary charging.

Charging is then maintained for a particular period after complementary charging to rapidly attenuate residual vibrations in the ink system in the same way as described in the first embodiment of a drive method above. Gradual discharging as shown by V35 is then applied, allowing diaphragm 8 to return to the standby state without causing unnecessary ink ejecting or harmful ink vibrations in the ink chamber.

It is to be noted that in the embodiments above the timing at which charging and discharging start and stop, i.e., t1 to t7 and ta to tc, may be generated by a timing generator or timer 32 (FIG. 2) of various known designs. For example, a clock signal with a constant period may be counted by a counter for which the initial value can be set. The necessary timing signals can then be easily generated using a carrier signal generated when the counter overflows. This configuration allows the timing signal to be freely adjusted by controlling the initial value set to the counter.

If a microprocessor is used to input the initial value, it is possible, for example, to change the V33 rise timing between ta and tc according to the print data. This makes it possible to easily control and vary the ink droplet eject volume. The ink drop eject period is typically several hundred microseconds long, easily within the control capacity of today's microprocessors. Hard wired logic can be alternatively used, however, to achieve even higher printing speeds.

As described hereinabove, the ink jet head apparatus and drive method according to the present invention follows charging/discharging for ink droplet ejecting with complementary charging/discharging to forcibly constrain vibration of the diaphragm after ink droplet ejecting. This makes it possible to rapidly attenuate any residual vibration of ink chamber pressure after ink droplet ejecting, and permits the next ink droplet ejecting operation to be executed without delay.

In addition, by appropriately setting the start timing of complementary charging during the period before ink droplet ejecting, the specific vibration period of the ink system can be effectively changed, and the ink droplet eject volume variably controlled.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet head, comprising:

an ink nozzle for ejecting ink drops;

an ink chamber having at least one wall and a volume and extending into communication with said ink nozzle for storing ink;

an elastic diaphragm formed in said at least one wall of said ink chamber;

a diaphragm drive circuit connected to said diaphragm to selectively deform said diaphragm and alter the volume of said ink chamber;

a substantially stationary wall disposed externally to said ink chamber opposing said diaphragm and a gap separating said stationary wall from said diaphragm when said diaphragm is not deformed;

a signal generator in communication with said diaphragm drive circuit for applying a charge signal and a first discharge signal to said diaphragm drive circuit to eject an ink drop from said nozzle;

a timer in communication with said signal generator for timing a predetermined interval after application of said charge signal; and wherein said signal generator applies a subsequent charge signal after said predetermined interval to displace said diaphragm to contact said stationary wall to reduce residual vibration in said diaphragm after application of said charge signal.

2. The ink jet head of claim 1, wherein the predetermined interval is selected such that said signal generator applies said subsequent charge signal while the diaphragm is being displaced from a position in which the volume of said ink chamber is minimized to a position where said diaphragm is closest to said stationary wall.

3. The ink jet head of claim 2, wherein said predetermined interval is selected such that said signal generator applies said subsequent charge signal when the diaphragm is displaced to a position closest to said stationary wall.

4. The ink jet head of claim 1, wherein said diaphragm drive circuit comprises an electrostatic actuator including said diaphragm and an electrode positioned on said stationary wall opposing said diaphragm;

wherein said charge signal induces electrostatic attraction between said diaphragm and said electrode to displace said diaphragm towards said stationary wall; and said first discharge signal discharges said electrostatic actuator at a first discharge rate to release said diaphragm to move towards said ink chamber, alter the volume of said ink chamber, and force ejection of the ink drop; and wherein said subsequent charge signal displaces said diaphragm to contact said stationary wall; and said signal generator applies a second discharge signal for discharging said electrostatic actuator at a second discharge rate slower than said first discharge rate.

5. The ink jet head of claim 2, wherein said diaphragm driving circuit comprises an electrostatic actuator whereby a charge is stored between said diaphragm and said stationary wall to selectively induce electrostatic attraction therebetween and elastically displace said diaphragm towards said stationary wall, said stored charge being subsequently discharged for displacing said diaphragm towards an interior of said ink chamber and away from said stationary wall;

wherein said diaphragm driving circuit further comprises a charging circuit for charging said electrostatic actuator; and a first discharge circuit for discharging said electrostatic actuator at a first discharge rate; and a second discharge circuit for discharging the electrostatic actuator at a second discharge rate slower than the first discharge rate.

6. The ink jet head of claim 1, wherein said diaphragm comprises:

a first portion having a first thickness relative to said ink chamber and a first gap distance for separating said first portion from said stationary wall; and a second portion having a second thickness relative to said ink chamber and a second gap distance for separating said second portion from said stationary wall, said second gap distance being different from the first gap distance.

7. The ink jet head of claim 6, wherein said first and second diaphragm portions exhibit differing structural rigidities.

8. The ink jet head of claim 1, wherein said diaphragm comprises:

a first portion having a first area relative to said ink chamber; and a second portion having a second area relative to said ink chamber different from said first area, said first and second diaphragm portions exhibiting differing structural rigidities.

9. A method for ejecting ink from an ink jet head including an ink ejection chamber including a deformable diaphragm, an externally disposed stationary wall separated from and opposing the diaphragm, and a means for selectively deforming the diaphragm, the method comprising the steps of:

(a) applying a charge signal to the deforming means to force expulsion of an ink drop from the ink ejection chamber;

(b) waiting a predetermined time period; and (c) applying a subsequent charge signal to the deforming means to deform the diaphragm into contact with the stationary wall, thereby reducing residual vibration in the diaphragm.

10. The method of claim 9, wherein the predetermined time period is selected such that said applying step (c) is initiated while the diaphragm is being displaced from a position in which ink chamber volume is minimized to a position where the diaphragm is closest to the stationary wall.

11. The method of claim 9, wherein said waiting step (b) comprises selecting a time within the predetermined time period and step (c) comprises applying said subsequent charge signal at said selected time.

12. The method of claim 9, wherein the deforming means comprises an electrostatic actuator;

wherein said charge signal applying step (a) comprises:

(1) applying a charge signal to the electrostatic actuator to deform the diaphragm against the stationary wall; and (2) subsequently applying a first discharge signal to the electrostatic actuator for discharging said electrostatic actuator at a first discharge rate to release the diaphragm towards an interior of the ink ejection chamber, alter a volume of the ink ejection chamber, and force ejection of the ink drop; and wherein said subsequent charge signal applying step (c) comprises:

(1) applying a subsequent charge signal to said electrostatic actuator for deforming the diaphragm to contact the stationary wall; and (2) applying a second discharge signal for discharging the electrostatic actuator at a second discharge rate slower than said first discharge rate.

13. An ink jet recording apparatus, comprising:

an ink nozzle for ejecting ink drops;

an ink chamber having at least one wall and a volume and extending into communication with said ink nozzle for storing ink;

an elastic diaphragm formed in said at least one wall of said ink chamber;

a diaphragm drive circuit connected to said diaphragm to selectively deform said diaphragm and alter the volume of said ink chamber;

a substantially stationary wall disposed externally to said ink chamber opposing said diaphragm and a gap separating said stationary wall from said diaphragm when said diaphragm is not deformed;

a signal generator in communication with said diaphragm drive circuit for applying a charge signal and a first discharge signal to said diaphragm drive circuit to eject an ink drop from said nozzle;

a timer in communication with said signal generator for timing a predetermined interval after application of said charge signal; wherein said signal generator applies a subsequent charge signal after said predetermined interval to displace said diaphragm to contact said stationary wall to reduce residual vibration in said diaphragm after application of said charge signal.

14. The recording apparatus of claim 13, wherein the predetermined interval is selected such that said signal generator applies said subsequent charge signal while the diaphragm is displaced from a position in which the volume of said ink chamber is minimized to a position where said diaphragm is closest to said stationary wall.

15. The recording apparatus of claim 13, wherein said predetermined interval is selected such that said signal generator applies said subsequent charge signal when the diaphragm is displaced to a position closest to said stationary wall.

16. The recording apparatus of claim 13, wherein said diaphragm driving circuit comprises an electrostatic actuator including said diaphragm and an electrode positioned on said stationary wall opposing said diaphragm;

wherein said charge signal induces electrostatic attraction between said diaphragm and said electrode to displace said diaphragm towards said stationary wall; and said first discharge signal discharges said electrostatic actuator at a first discharge rate to release said diaphragm to move towards said ink chamber, alter the volume of said ink chamber, and force ejection of the ink drop; and wherein said subsequent charge signal displaces said diaphragm to contact said stationary wall; and said signal generator applies a second discharge signal for discharging said electrostatic actuator at a second discharge rate slower than said first discharge rate.

17. The recording apparatus of claim 14, wherein said diaphragm driving circuit comprises an electrostatic actuator whereby a charge is stored between said diaphragm and said stationary wall to selectively induce electrostatic attraction therebetween and elastically displace said diaphragm towards said stationary wall, said stored charge being subsequently discharged for displacing said diaphragm towards an interior of said ink chamber and away from said stationary wall;

wherein said diaphragm driving circuit further comprises a charging circuit for charging said electrostatic actuator; and a first discharge circuit for discharging said electrostatic actuator at a first discharge rate; and a second discharge circuit for discharging the electrostatic actuator at a second discharge rate slower than the first discharge rate.

18. The recording apparatus of claim 13, wherein said diaphragm comprises:

a first portion having a first thickness relative to said ink chamber and a first gap distance for separating said first portion from said stationary wall; and a second portion having a second thickness relative to said ink chamber and a second gap distance for separating said second portion from said stationary wall, said second gap distance being different from the first gap distance.

19. The recording apparatus of claim 18, wherein said first and second diaphragm portions exhibit differing structural rigidities.

20. The recording apparatus of claim 13, wherein said diaphragm comprises:

a first portion having a first area relative to said ink chamber; and a second portion having a second area relative to said ink chamber different from said first area, said first and second diaphragm portions exhibiting differing structural rigidities.

21. An ink jet recording apparatus, comprising:

an ink nozzle for ejecting ink drops;

an ink chamber having at least one wall and a volume and extending into communication with said ink nozzle for storing ink;

an elastic diaphragm formed in said at least one wall of said ink chamber;

means for deforming the diaphragm to alter the volume of said ink chamber;

a substantially stationary wall disposed externally to said ink chamber opposing said diaphragm and a gap separating said stationary wall from said diaphragm when said diaphragm is not deformed;

means for applying a first charge signal and a first discharge signal to said deforming means to eject an ink drop from said nozzle; and wherein said applying means subsequently applies a second charge signal to displace said diaphragm to contact said stationary wall to reduce residual vibration in said diaphragm after application of said first charge signal.

* * * * *

UNITED STATES PATENT AND TRADEMARK OFFICE

CERTIFICATE OF CORRECTION

PATENT NO. : 6,234,607 B1
DATED : May 22, 2001
INVENTOR(S) : Sakai et al.

It is certified that error appears in the above-identified patent and that said Letters Patent is hereby corrected as shown below:

Title page,
Insert -- [*] Notice: Under 35 U.S.C. 154(b), the term of this patent shall be extended for 0 days. --.

Column 16,
Line 13, after ";" insert -- and --.

Signed and Sealed this

Third Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,234,607 B1
DATED : May 22, 2001
INVENTOR(S) : Shinri Sakai et al.

It is certified that error appears in the above-identified patent and that said Letters Patent is hereby corrected as shown below:

Column 16,
Line 13, after ";" insert -- and --.

Signed and Sealed this

Thirty-first Day of December, 2002

JAMES E. ROGAN
*Director of the United States Patent and Trademark Office*